US005810113A

United States Patent [19]

Jones

[11] Patent Number: 5,810,113

[45] Date of Patent: Sep. 22, 1998

[54] PORTABLE TREE CLIMBING DEVICE

[76] Inventor: Earl R. Jones, P.O. Box 400, Cedar Hill, Mo. 63016

[21] Appl. No.: 723,113

[22] Filed: Sep. 30, 1996

[51] Int. Cl.[6] ..... E04G 3/00

[52] U.S. Cl. ..... 182/92; 182/90

[58] Field of Search ..... 182/92, 90; 248/213.4, 248/230.1, 230.8

[56] References Cited

U.S. PATENT DOCUMENTS

| | | | |
|---|---|---|---|
| D. 303,155 | 8/1989 | Ayers | 182/92 |
| 698,865 | 4/1902 | Smith et al. | 182/92 X |
| 1,103,719 | 7/1914 | Wheeler | 182/90 |
| 1,153,750 | 9/1915 | Berry | 182/92 |
| 2,097,562 | 11/1937 | Day | 182/92 X |
| 3,345,028 | 10/1967 | Lawrie | 248/230.8 |
| 3,598,201 | 8/1971 | Thurmond | 182/92 |
| 3,746,294 | 7/1973 | Johnston | 248/230.8 X |
| 4,027,742 | 6/1977 | House, Jr. | 182/92 |
| 4,249,716 | 2/1981 | Barron | 248/230.8 X |
| 4,415,061 | 11/1983 | Meyer | 182/92 |
| 4,449,612 | 5/1984 | Southard | 182/92 |
| 4,527,660 | 7/1985 | Andruchiw | 182/136 |
| 4,595,076 | 6/1986 | Gober | 182/136 |
| 4,600,801 | 7/1986 | Wade | 182/92 X |
| 4,618,028 | 10/1986 | Dale | 182/92 |
| 4,620,610 | 11/1986 | Southard | 182/92 |
| 4,669,575 | 6/1987 | Skyba | 182/92 |
| 4,699,347 | 10/1987 | Kuhnley | 248/230.8 X |
| 4,809,815 | 3/1989 | Wallace | 182/133 |
| 4,928,793 | 5/1990 | Westimayer et al. | 182/92 X |
| 5,311,967 | 5/1994 | Kennedy | 182/133 |
| 5,361,869 | 11/1994 | Ledbetter | 182/133 |
| 5,407,025 | 4/1995 | Nickel | 182/92 |

OTHER PUBLICATIONS

API Outdoors p. 217 (Item 29–659–344–00) Bass Propshops Red Head Hunting Specialists Catalog 1996 Issue.

Loc–On Manufacturing Co. p. 94 (Item 199P9574) Gander Mountain Archery 1994 Catalog.

*Primary Examiner*—Alvin C. Chin-Shue
*Assistant Examiner*—Richard M. Smith
*Attorney, Agent, or Firm*—Howell & Haferkamp, LC

[57] ABSTRACT

A portable tree climbing device that provides secure hand grip and foot support to a climbing person without causing harmful damage to trees. The device is formed from a single sheet of rigid material and is attached to the tree with a commercially available strap and buckle assembly. The device is made progressively tighter about the tree's girth with the application of the weight of the user and has the inherent ability to retain this tight relationship with the tree after the user's weight has been removed.

14 Claims, 1 Drawing Sheet

PORTABLE TREE CLIMBING DEVICE

BACKGROUND

1. Field of the Invention

This invention relates generally to a tree climbing device and more particularly to an improved tree climbing device that provides superior hand grip and foot support to a climbing person without causing harmful damage to subject trees.

2. Description of Prior Art

It is well known that hunters often employ the strategy of climbing trees to aid in the pursuit of their quarry. It is felt that an elevated position offers an advantage that might not otherwise be attained. Since few trees in desirable hunting locations have sufficient limbs to be readily climbable, the hunter has devised many artificial methods and devices for climbing the existing trees in these preferred locations. Steel spikes driven into trees, or a series of short pieces of lumber nailed into position was often a quick solution. However, because this method of hunting has become so enormously popular, the prospect of having virtually uncountable numbers of nails and the like driven into countless trees has prompted many conservation officials and concerned land owners to prohibit this practice on the lands they control.

One of the more practical methods of compliance developed by hunters has been the use of screw-in tree steps. Representative examples of this type of step were disclosed in U.S. Pat. No. 4,415,061 to Meyer on Sep. 1, 1982 and in U.S. Pat. No. 4,669,575 to Skyba on Oct. 27, 1986. These removable screw-in steps are practical and readily portable. However, their insertion into a tree involves breaking through the protective layer of bark and into the layers of living cells just within. This is believed by many to subject the tree to the possible invasion of harmful insects or bacteria. For this reason, use of screw-in steps are discouraged by many landowners and conservation departments.

Other devices for climbing trees have been developed. Some of these provide adjustable bands or straps that encircle the tree trunk. In general, these devices possess abilities to function without harmful effects to trees but may require rather uncommon athletic ability to operate. They may also require disassembly and re-assembly to maneuver around any tree limb encountered. U.S. Pat. No. 4,809,815 to Wallace on Apr. 19, 1988 discloses a flexible band which encircles the tree and to which a handle is attached. The user hangs by hands and arms from this handle while re-positioning an auxiliary foot support. U.S. Pat. No. 4,595,076 to Gober on Sep. 4, 1985 shows another flexible band that is made tight to the tree by twisting a lever. Again, the user hangs by hands and arms while re-positioning an auxiliary foot support. Yet another flexible, adjustable band with an attached bar for gripping by hand is shown in U.S. Pat. No. 5,311,967 to Kennedy on May 5, 1993. U.S. Pat. No. 4,527,660 to Andruchiw on Jan. 4, 1984 shows a hand grip member to which a snap-hook is secured by a clamp for removably attaching a safety line that is loosely attachable to a pole while the climber is supported by a safety harness as he or she climbs the pole with the aid of spurs attached to climbing boots.

Still another method for climbing trees involves the use of generally "L" shaped individual steps that are releasably securable to trees. Examples of this type of step are shown in U.S. Pat. No. 3,598,201 to Thurmond on Aug. 10, 1971, and in U. S. Pat. No. 5,361,869 to Ledbetter on Oct. 12, 1993. Other examples are shown as articles of manufacture by API Outdoors Inc., and LOC-ON Manufacturing Co. in sales catalogs distributed by Gander Mountain of Wilmot, Wis., and Bass Pro Shops of Springfield, Mont. All of these steps are attached by means of a chain, strap, or rope that is made to encircle the tree. They are attached as tightly as possible by hand. When, by standing on the step, the additional weight of a person is applied, the step slides slightly downward along the tree trunk. This downward slide is accomplished against the limited stretch characteristic of the attachment means. The result of this applied strain is a temporarily tighter step to tree relationship. When the additional weight is removed, the stress is relieved and the step and its attachment means slide back upward to the original hand-tight position. The downward, tight relationship between the step and the tree is lost because there is simply no method employed to retain this desirable position.

It is therefore an object of this invention to provide an improved tree climbing device.

It is another object of this invention to provide an improved tree climbing device that allows for both more secure hand grip and foot support than is presently available in the prior art.

It is another object of this invention to provide an improved tree climbing device that may be made progressively tighter about a tree's girth by application of the weight of the user.

In accordance with the immediately preceding object, it is another object to provide an improved tree climbing device that may be may be made progressively tighter about a trees girth by application of the weight of the user and has the inherent ability to retain this tight relationship after the user's weight is removed.

It is a further object of the present invention to provide an improved tree climbing device that is of one-piece construction.

In accordance with the immediately preceding object it is another object of this invention to provide an improved tree climbing device that is of one piece construction and a plurality of which may be interchangeably stacked, one within another.

It is another object of this invention to provide an improved tree climbing device that is light in weight, compact in size, and therefore readily portable.

It is still another object of this invention to provide an improved tree climbing device that may be easily and inexpensively manufactured.

It is another object of this invention to provide an improved tree climbing device that is of durable and reliable construction.

It is a final object of this invention to provide an improved tree climbing device that accomplishes all of the above objectives in a manner that is environmentally safe and will not cause harmful damage to trees.

These and other objects and advantages as well as the novel features of the invention will become apparent from the following description and the accompanying drawings.

DETAILED DESCRIPTION OF THE DRAWINGS

Figure 1:
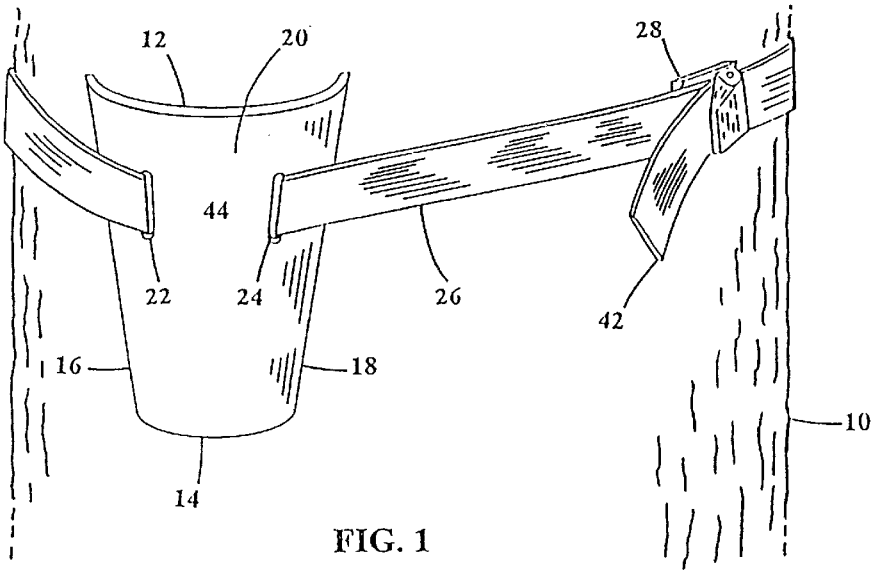
FIG. 1 is a top perspective view of the present invention.
Figure 2:
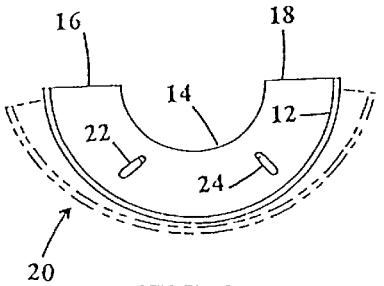
FIG. 2 is a top plan view showing the invention in a pre-installed, relaxed configuration and in phantom in an installed, spread configuration.
Figure 3:
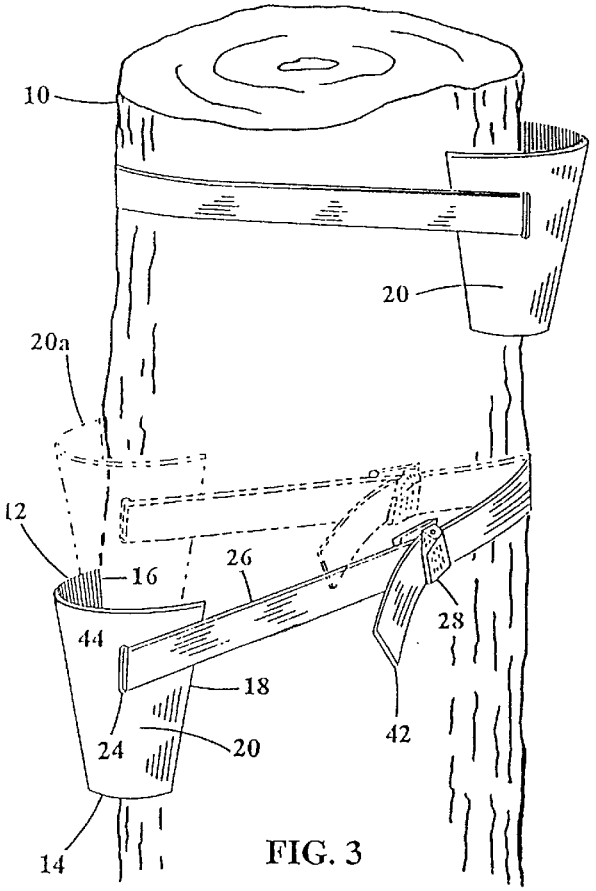
FIG. 3 is a top perspective view showing a section of tree trunk with two steps of the present invention installed in alternate climbing positions. The lowermost step is shown in its hand tight, installed position, and in phantom in the position displayed after application of the weight of a climbing person.

With reference to the drawings, FIGS. 1, 2, and 3 show the improved tree climbing device which may more briefly referred to as a step 1 or a tree engageable member and is designated by the numeral 20. The step 20, which has a conical taper, has a surface area of approximately 32 square inches and may be rolled, bent or otherwise formed from a single piece of sheet aluminum by any of several conventional manufacturing techniques. Because aluminum is lightweight, flexible and strong, it is the preferred material of construction.

Figure 4:
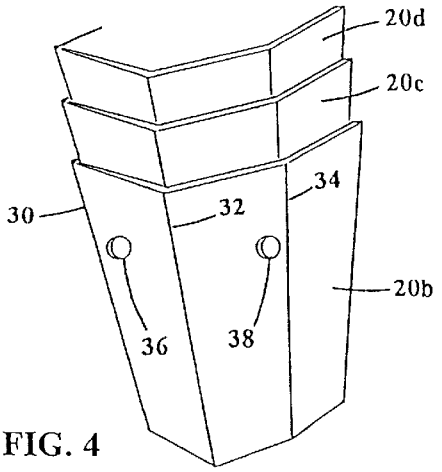
FIG. 4 is a top perspective view of an alternate embodiment showing the compact stacking arrangement of three steps of the current invention.

In FIG. 1, the step 20 comprises a face 44, an upper edge or stepping surface 12, a lower edge 14, a first generally vertical edge 16, and a second generally vertical edge 18. Edges 12 and 14 generally parallel each other with the upper edge 12 being approximately twice the length of the lower edge 14. The center points of each edge are in the same vertical alignment as is illustrated in FIG. 4, line 32 of an alternate embodiment. In FIG. 1, upper edge 12 and lower edge 14 are connected by first generally vertical edge 16 and second generally vertical edge 18. From the lower edge 14, edges 16 and 18 are disposed at oblique angles upwardly and outwardly to join upper edge 12.

Also in FIG. 1, first slot 22 and second slot 24 are provided on face 44. The slots 22 and 24 are disposed approximately two inches from the respective first and second vertical edges 16 and 18 and nearer the upper edge 12 than the lower edge 14. The slots, which parallel their respective edges, are of a length adequate to provide housing for tensioning member, preferably a tree circumscribing member such as a strap 26 as shown in FIG. 1. Strapping of sufficient strength to safely support the weight of the user is a common article of manufacture and readily available. The strap is of sufficient length to encircle the subject tree, has a first loose end 42 and a second end attachable to a suitable, commercially available, connecter, such as a non-slip buckle 28 as shown in FIGS. 1 and 3. A representative example of such a buckle is shown in FIG. 8 of the drawings in U.S. Pat. No. 4,648,483 to Skyba on Nov. 1, 1985.

FIG. 2 is a top plan view and shows the step 20 in a relaxed, loose configuration and in phantom in the spread formation caused by the application of and subsequent removal of the user's weight.

FIG. 3 is a top perspective view showing a section of tree trunk 10 with two steps of the present invention installed. The top step 20 is installed in its tightly attached climbing position. The lowermost step 20 is shown installed in the position taken after the application of the weight of the user, and in phantom 20*a* in a hand tight position.

FIG. 4 is a perspective view of an alternate embodiment of the current invention. Bends at 30, 32, and 34 create the angular shape of the step 20*b*. Holes 36 and 38, FIG. 4, provide housing for a rope (not shown) which may provide attachment means to a tree when tied with a suitable non-slip knot. Additionally, in FIG. 4, steps 20*b*, 20*c*, and 20*d* show the stacking arrangement used to provide for compact portability.

In use, in FIG. 1, a strap 26 of sufficient length to encircle the tree is fed through slots 22 and 24 of the face 44 of the step 20. The strap 26 and the buckle 28 are made to connect in a manner common to such articles of manufacture. The loose end 42 of the strap 26 is pulled as tightly as possible by hand strength. The non-slip action of the buckle 28 will cause the step strap arrangement to remain in this hand tight position after the strain on the loose end 42 is relieved. At this point the step 20 is a suitable tree climbing aid and is as functional as much of the prior art. In many cases, the user will install three or four steps in the alternating manner suggested by FIG. 3 while standing on the ground. The user then begins the ascent of the tree by gripping the top edge 12 of one step 20 with the fingers of one hand and the top edge 12 of another step with the fingers of the other hand. As seen in FIG. 3, the outward curvature of the step's top edge 12 provides ample space between the step's top edge 12 and the tree trunk 10 for a secure hand grip. In alternating fashion, the steps are first used as hand grips and then as foot support. Additional features begin to appear as the user's weight is applied by stepping on the top edge 12 of the step 20.

In response to the increased weight, the step 20 will slide slightly downward along the trunk of the tree 10 as seen in FIG. 3. However this downward slide is accomplished against the low-stretch characteristic of the strap 26 and the non-slip feature of the buckle 28. The strap used in this example is a one inch polypropylene webbing that has a breaking strength of approximately 1100 pounds. The strap has 3–4 percent of stretch at its rated capacity. The downward application of the user's weight upon the step 20 causes the strap 26 to stretch and results in a very tight relationship between the step, the strap, and the tree trunk. When the user's weight is removed from the step 20, the strain imposed upon the strap is relieved. The strap will attempt to return upward to its pre-stretched length and position. This contraction effort will tend to urge the strap-containing step 20 on a return trip upward along the tree's trunk. At this point, with the step being very tight against the trunk of the tree, the friction encountered by the obliquely angled edges 16 and 18 is too great to allow unhindered upward travel of the step 20. Since the upward movement of the step 20 is thus precluded, any further movement of the step 20 takes another direction in response to the contraction of the strap 26. The edges 16 and 18, FIG. 1, will tend to move slightly upwardly and outwardly along a course in line with the obliquely disposed edges. As mentioned, the aluminum material is strong and flexible. This movement, as seen in phantom in FIG. 2, is accomplished against this resilient flexibility. The edges 16 and 18 FIG. 2 therefore spread outward under spring-like tension to prevent the complete contraction of the strap 26. The result is a portion of the applied weight of the user is stored in the strap 26 and the step 20 because of the inherent springability of the step 20. The step remains tight against the tree to provide improved hand grip and foot support to a climbing person.

To remove the step 20 from the tree, a slight upward pull relieves the stored tension to allow for easy disassembly.

Although the foregoing contains specificities of construction and operation it is not desired to limit the invention thereto. Whereas the drawings and accompanying description have shown and described a preferred embodiment it should be apparent to those skilled in the art that various changes and modifications may be made in the form of the invention without affecting the scope thereof.

I claim:

1. A portable step comprising a resilient tree engageable member and a tree circumscribing member adapted to at least partially circumscribe an exterior surface of a tree, the tree circumscribing member being adapted for urging the tree engageable member against the exterior surface of the tree, the tree engageable member being adapted for engagement with the exterior surface of the tree in a manner to maintain the portable step in an elevated position to assist a user in climbing the tree, the tree engageable member having a lower edge, an upper edge spaced above the lower edge, and first and second side edges spaced laterally from one another, each of the first and second side edges having a lower end and an upper end, the lower ends of the side edges being adjacent the lower edge, the upper ends of the side edges being adjacent the upper edge, each of the first and second side edges extending upwardly from the lower edge to the upper edge, the tree engageable member being shaped and adapted so that the first and second side edges are engageable with the exterior surface of the tree when the tensioning member urges the tree engageable member against the exterior surface of the tree, the tree engageable member being adapted for movement between an unflexed configuration wherein the upper ends of the first and second side edges are a first distance from one another and a flexed configuration wherein the upper ends of the first and second side edges are a second distance from one another, the second distance being greater than the first distance, the tree engageable member being adapted to move from its unflexed configuration to its flexed configuration when the step is changed from an unloaded condition to a loaded condition, the step being in the unloaded condition when a user is not stepping on the portable step and being in the loaded condition when a user stands on the portable step, the resiliency of the tree engageable member tending to urge the first and second side edges toward each other when the step is changed from its loaded condition to its unloaded condition, the tree engagable member being shaped so that the first and second side edges diverge from one another as they extend from the lower edge to the upper edge when the tree engageable member is in its unflexed configuration, the upper edge of the tree engageable member including a medial portion shaped and adapted to be spaced from the exterior surface of the tree when the first and second side edges are in engagement with the exterior surface of a portion of the tree having a diameter greater than the second distance, the tree engageable member having an intermediate portion between the first and second side edges, the tree circumscribing member being attached to the intermediate portion of the tree engageable member in a manner for urging the first and second side edges against the exterior surface of the tree.

2. The portable step of claim 1 wherein the tree circumscribing member comprises a flexible strap of sufficient length to circumscribe the tree.

3. The portable step of claim 2 further comprising a connector connected to the strap, the connector being configured for maintaining the strap in circumscribing relation around the tree and in engagement with the exterior surface of the tree.

4. The portable step of claim 2 wherein the tree engageable member has at least one aperture sized to receive a portion of the strap therethrough for holding the tree engageable member against the tree.

5. The portable step of claim 4 wherein the tree engageable member includes two slots sized to receive portions of the strap therethrough for holding the tree engageable member against the tree.

6. The portable step of claim 1 wherein the tree circumscribing member is of a material which has limited elasticity so that when the tree engageable member is in its loaded condition, then the strap stretches thereby resulting in limited downward movement of the tree engageable member along the exterior surface of the tree, the elasticity of the circumscribing member tending to urge the tree engageable member upwardly along the exterior surface of the tree when the loaded condition is removed.

7. The portable step of claim 1 wherein the tree circumscribing member and tree engageable member are adapted so that tension in the tree circumscribing member increases as the tree engageable member is placed in its loaded condition.

8. The portable step of claim 7 wherein when the loaded condition is removed, then friction between the first and second side edges of the tree engageable member and the exterior surface of the tree inhibits upward movement of the tree engageable member relative to the exterior surface of the tree.

9. The portable step of claim 1 wherein the first and second side edges of the tree engageable member are each in an oblique relationship with the upper edge.

10. The portable step of claim 9 wherein the first and second side edges are arranged in a generally V-shaped configuration so that upward movement of the tree engageable member along the exterior surface of the tree is at least partially translated into outward movement of the first and second side edges.

11. The portable step of claim 1 wherein the medial portion of the upper edge of the tree engageable member is spaced from the exterior surface of the tree to define an interior space between the upper edge and the exterior surface of the tree for secure placement of a hand or foot of the user.

12. The portable step of claim 11 wherein the upper edge is at least about twice as long as the lower edge.

13. The portable step of claim 11 wherein the upper edge is curved.

14. The portable step of claim 1 wherein the tree engageable member has a curvature defining a generally partial conical configuration of the tree engageable member which permits a plurality of identical tree engageable members to be nested with one another for compact portability.

* * * * *